US007361089B2

(12) United States Patent
Daly et al.

(10) Patent No.: US 7,361,089 B2
(45) **Date of Patent: *Apr. 22, 2008**

(54) MULTI-REEL SLOT MACHINE WITH SELECTABLE REEL PLAY

(75) Inventors: Terence G. Daly, Las Vegas, NV (US); David B. Schultz, Henderson, NV (US); Marvin A. Hein, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 312 days.

This patent is subject to a terminal disclaimer.

(21) Appl. No.: 11/230,817

(22) Filed: Sep. 19, 2005

(65) Prior Publication Data

US 2006/0287036 A1 Dec. 21, 2006

Related U.S. Application Data

(63) Continuation-in-part of application No. 11/088,482, filed on Mar. 24, 2005, now Pat. No. 7,108,602, which is a continuation of application No. 10/616,264, filed on Jul. 8, 2003, now Pat. No. 6,896,617.

(51) Int. Cl.
*A63F 9/24* (2006.01)

(52) U.S. Cl. ..... 463/20; 273/143 R

(58) Field of Classification Search ..... 463/20; 273/143 R

See application file for complete search history.

(56) References Cited

U.S. PATENT DOCUMENTS

| | | | |
|---|---|---|---|
| 4,695,053 | A | 9/1987 | Vazquez, Jr. et al. |
| 4,836,546 | A | 6/1989 | DiRe et al. |
| 5,704,835 | A | 1/1998 | Dietz, II |
| 5,775,692 | A | 7/1998 | Watts et al. |
| 5,935,002 | A | 8/1999 | Falciglia |
| 6,015,346 | A | 1/2000 | Bennett |
| 6,062,980 | A | 5/2000 | Luciano |
| 6,068,552 | A | 5/2000 | Walker et al. |
| 6,120,378 | A | 9/2000 | Moody et al. |
| 6,159,095 | A | 12/2000 | Frohm et al. |
| 6,270,412 | B1 | 8/2001 | Crawford et al. |
| 6,379,245 | B2 | 4/2002 | De Keller |

(Continued)

FOREIGN PATENT DOCUMENTS

GB 2 097 160 A 10/1982

*Primary Examiner*—Corbett Coburn
*Assistant Examiner*—David W Duffy
(74) *Attorney, Agent, or Firm*—Andrew B. Chen; J. P. Cody

(57) ABSTRACT

A reel spinning gaming device comprises a plurality of selectable reels, where a subset of the selectable reels is the initial active reels. The actuating system is operatively associated with the selectable reels and generates an outcome symbol combination for the active reels. The prize controller determines whether a prize is to be awarded based upon the outcome symbol combination. In one embodiment, the prize controller also initiates a bonus game when a triggering event is present. The reselection system designates a new set of active reels the bonus game(s). The new set of active reels comprises one or more newly active reels and one or more remaining active reels, and the outcome symbols from the one or more newly active reels are used in conjunction with the outcome symbols from the remaining active reels to produce a outcome symbol combination for one or more bonus games.

24 Claims, 10 Drawing Sheets

U.S. PATENT DOCUMENTS

| | | | | |
|---|---|---|---|---|
| 6,896,617 | B2 | 5/2005 | Daly | |
| 7,108,602 | B2 * | 9/2006 | Daly | 463/20 |
| 2001/0046890 | A1 | 11/2001 | Ferguson | |
| 2001/0054794 | A1 | 12/2001 | Cole et al. | |
| 2002/0014740 | A1 | 2/2002 | Ainsworth | |
| 2002/0055381 | A1 | 5/2002 | Tarantino | |
| 2003/0199320 | A1 | 10/2003 | Nguyen et al. | |
| 2005/0181861 | A1 | 8/2005 | Kodachi | |

* cited by examiner

MULTI-REEL SLOT MACHINE WITH SELECTABLE REEL PLAY

CROSS-REFERENCE TO RELATED APPLICATIONS

This application is continuation-in-part application of U.S. patent application Ser. No. 11/088,482, filed Mar. 24, 2005, now U.S. Pat. No. 7,108,602 issued Sep. 19, 2006, which is a continuation of U.S. patent application Ser. No. 10/616,264, filed Jul. 8, 2003, now U.S. Pat. No. 6,896,617 issued May 24, 2005, wherein both the application and patent are hereby incorporated by reference in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

This invention relates generally to a reel spinning game, and more particularly, to a reel spinning game wherein a subset of reels is selected from a plurality of reels, the subset of reels being spun in an initial game, after which a reel from the subset is replaced with a reel not already included in the current subset, and that replacement reel is spun in the next game.

BACKGROUND

In a traditional reel-spinning slot machine, each spin of the reels is typically a separate and distinct game, which has no relationship with any prior or future game played on that machine. As such, there is a need for a game that will increase player excitement and maintain player interest between consecutive games. To address this issue, several different types of "second chance" games have been developed that try to maintain player interest from a first game segment to a second game segment by providing the player with another opportunity to win.

For example, some slot machines allow a player to "nudge" one of the reels so that a displayed symbol is replaced by an adjacent symbol on the reel. The success or failure of the game is then recalculated based upon the new symbol combination appearing after the reel has been nudged. While this nudging feature does address the issue of being one symbol short of a winning combination, it provides only limited relief. There is a continuing need for alternative slot machine variants that provide at least a "second chance" (or more) for a player to achieve a win, after initially achieving a win or a near win in a prior game, thereby maintaining player excitement between individual games.

Accordingly, it is desirable to provide a player with options for playing additional games that maintain some portion of the outcome symbol combination from the previous game, thus, avoiding the need for the player to start completely over with each new game. Further, there is a continuing need for a gaming machine that provides a player with the opportunity to overcome at least some of the frustration of being just short of a winning combination.

Accordingly, those skilled in the art have long recognized the need for a gaming machine that addresses these issues.

SUMMARY

Briefly, and in general terms, preferred embodiments are directed to reel spinning gaming devices that allow a player to play multiple games. In one preferred embodiment, the reel spinning gaming device comprises a plurality of selectable reels wherein a subset of the plurality of selectable reels is the initial active reels for a base game. An actuating system is operatively associated with the selectable reels and generates an outcome symbol combination for the active reels in the base game. A prize controller determines whether a prize is to be awarded based upon the outcome symbol combination of the base game and/or whether a triggering event is present to initiate a bonus game. If appropriate, a reselection system designates a new set of active reels for one or more bonus games. The new set of active reels comprises one or more newly active reels that were previously non-active reels and one or more remaining active reels. The outcome symbols from the one or more newly active reels are used in conjunction with the outcome symbols from the remaining active reels to produce an outcome symbol combination for one or more bonus games.

In another preferred embodiment, one or more outcome symbols are reserved only for the bonus games. In yet another preferred embodiment, the selectable indicia-bearing members are arranged in a grid composed of a plurality of rows and columns, and the grid having the shape of a square, diamond, triangle, or polygon. In another preferred embodiment, the prize controller is located on a server remote from the gaming device. In yet another preferred embodiment, the value of prize for the bonus game is greater than the value of the prize for the base game. In another preferred embodiment, the reselection system allows a player to purchase one or more indicia-bearing members for one or more subsequent games.

In a preferred reel spinning gaming method, the method includes providing a gaming device having a plurality of selectable reels having symbols thereon; selecting an initial set of active reels for an initial game, wherein the initial set of active reels is a subset of the plurality of selectable reels; spinning the initial set of active reels to generate an outcome symbol combination in the initial game; determining whether a prize is to be awarded based upon the outcome symbol combination in the initial game; determining whether to initiate one or more subsequent games based upon the outcome symbol combination; initiating subsequent games, if appropriate, by selecting a new set of active reels to replace one or more active reels, wherein the new set of active reels comprises one or more new active reels and the active reels remaining from a previous game; spinning one or more of the new active reels to generate an outcome symbol combination in the subsequent games; and determining whether a prize is to be awarded based upon the outcome symbol combination in the subsequent game in conjunction with the outcome symbols from the active reels remaining from the initial game.

Other features and advantages will become apparent from the following detailed description, taken in conjunction with the accompanying drawings, which illustrate by way of example, the features of the various embodiments.

DETAILED DESCRIPTION

Preferred embodiments of a reel spinning gaming device use a plurality of reels, some of which are designated as active reels and some of which are designated as non-active reels. The reel spinning gaming device provides a player with the opportunity to play multiple consecutive games with each subsequent consecutive game utilizing a subset of the reel symbols from the outcome symbol combination of the previous game. After an initial game that uses an initial set of active reels, the gaming device begins a second game by substituting a previously non-active reel from the initial game for an active reel from the initial game, thereby designating a new set of active reels for the second game. This new set of active reels for the second game includes the newly substituted active reel and the remaining active reels. The newly substituted active reel is spun for the second game while the remaining active reels are not spun for the second game. The outcome symbol from the newly substituted active reel is used in conjunction with the outcome symbols from the remaining active reels to produce an outcome symbol combination for the second game. The prize controller then performs a prize determination for the second game.

In this manner, the gaming device provides a player with the opportunity to play subsequent consecutive games in an attempt to improve upon the outcome symbol combination of the previous game. Accordingly, the gaming device creates and maintains more excitement for a player. For instance, after receiving a game result that includes an outcome symbol combination that constitutes a "near win" (i.e., one symbol away from a winning outcome symbol combination), the player still has the possibility of achieving a winning outcome symbol combination in a subsequent consecutive game.

Figure 1:
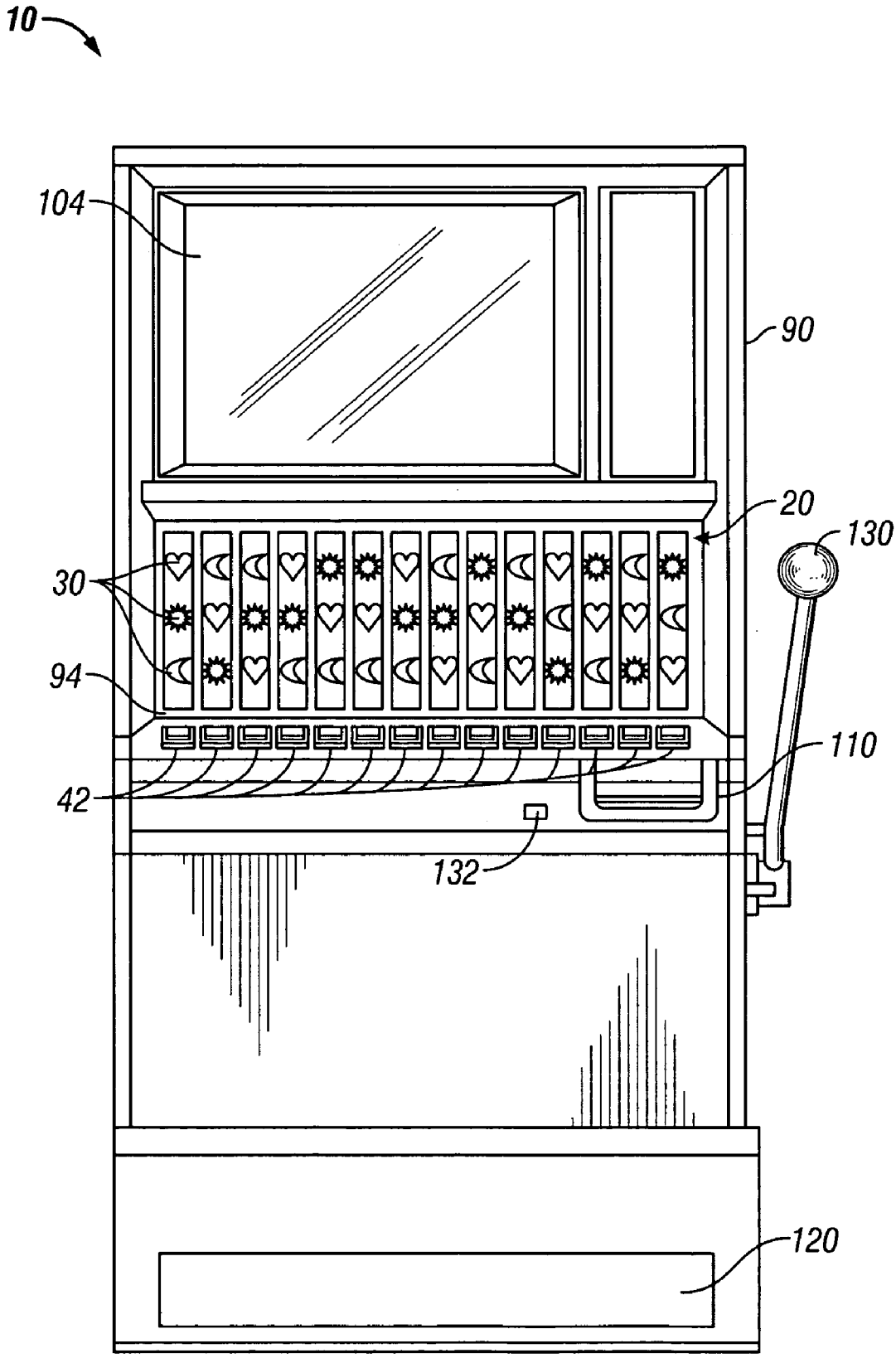
FIG. 1 illustrates a front view of a preferred embodiment, having fourteen selectable reels and associated selection buttons, the selection buttons being used as part of a selection system and a reselection system.
Figure 2A:
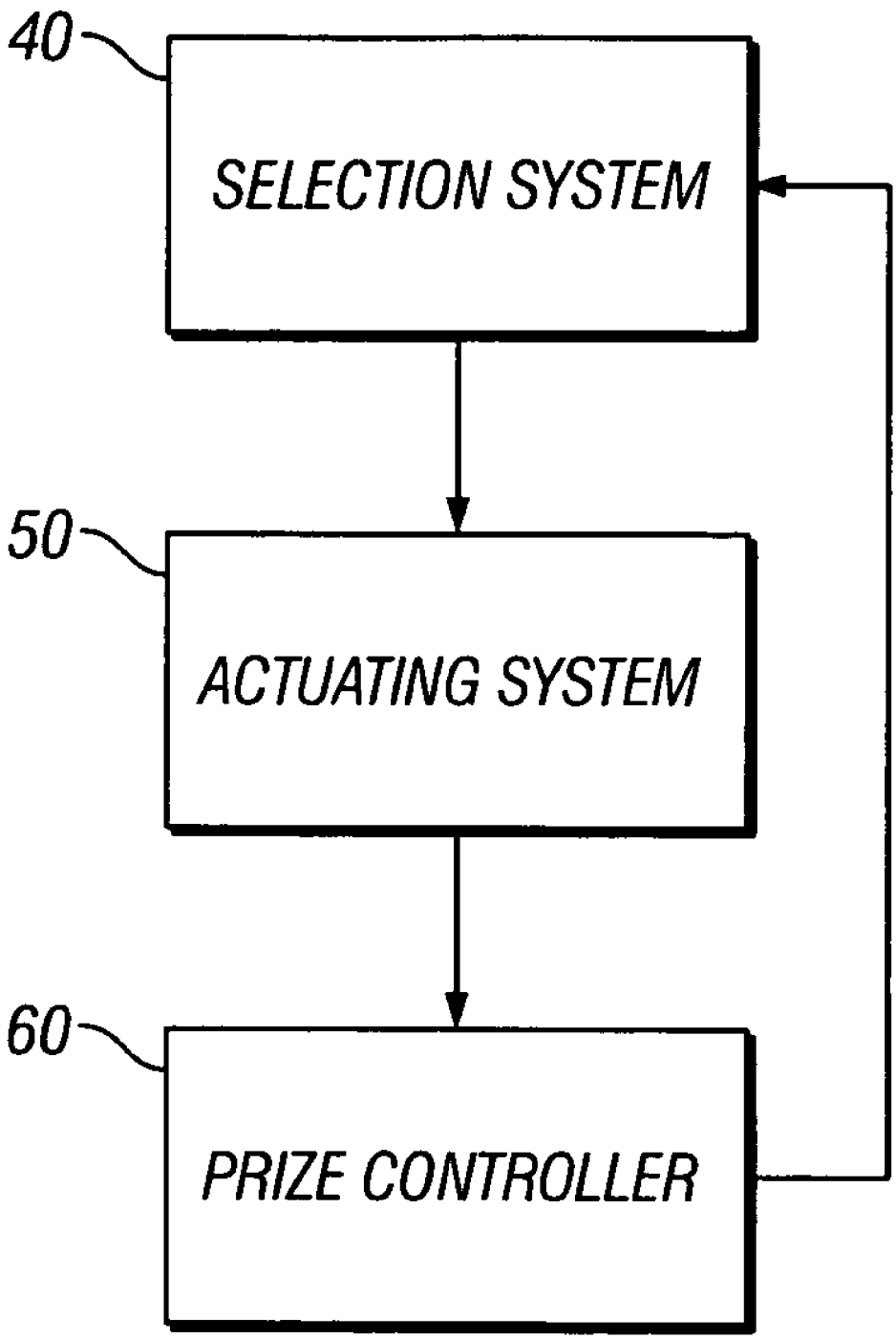
FIG. 2A illustrates a relational flow of a preferred method, showing the interaction of a selection system, an actuating system, and a prize controller.
Figure 3:
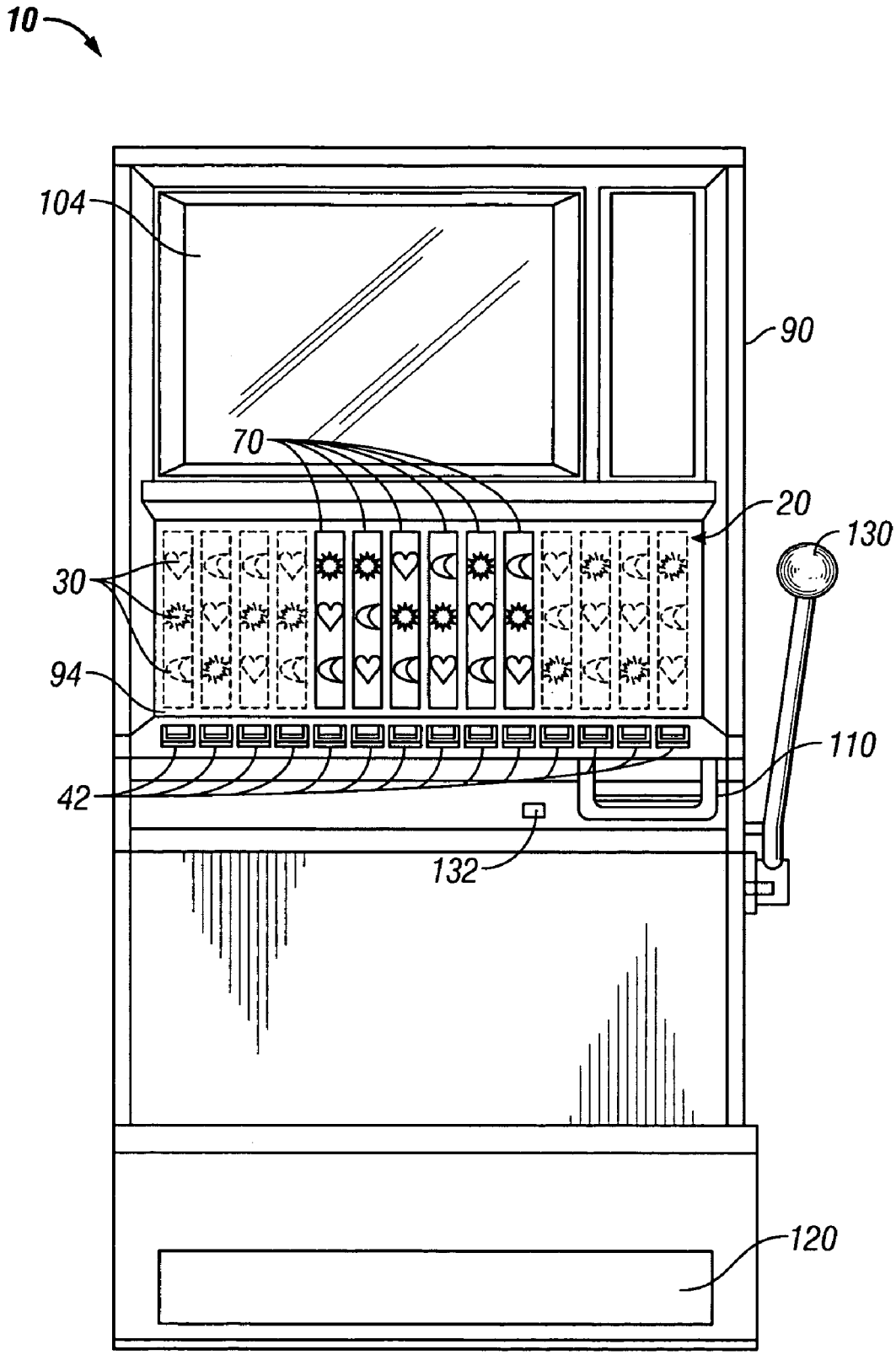
FIG. 3 illustrates a front view of the embodiment shown in FIG. 1, showing five of the selectable reels having been designated as active reels, as shown by the de-emphasizing of the non-active reels.

Referring now to the drawings, wherein like reference numerals denote like or corresponding parts throughout the drawings, and more particularly to FIGS. 1 and 3, there is shown a preferred reel spinning gaming device 10. Briefly stated, a preferred embodiment gaming device 10 includes a plurality of selectable reels 20 each having game symbols located thereon, a selection system 40, an actuating system 50, and a prize controller 60. Each reel 20 displays an outcome symbol 30 after having been spun. In one embodiment, the number of selectable reels 20 included in the gaming device 10 is greater than the number of reels used in an individual game. In this regard, as shown in FIG. 2A, the selection system 40 designates a subset of the selectable reels 20 as the initial active reels 70 for the initial game. The actuating system 50 then spins the initial active reels 70, after which the prize controller 60 determines whether or not a prize is to be awarded dependent upon the combination of the outcome symbols 30 from the initial active reels.

Figure 2B:
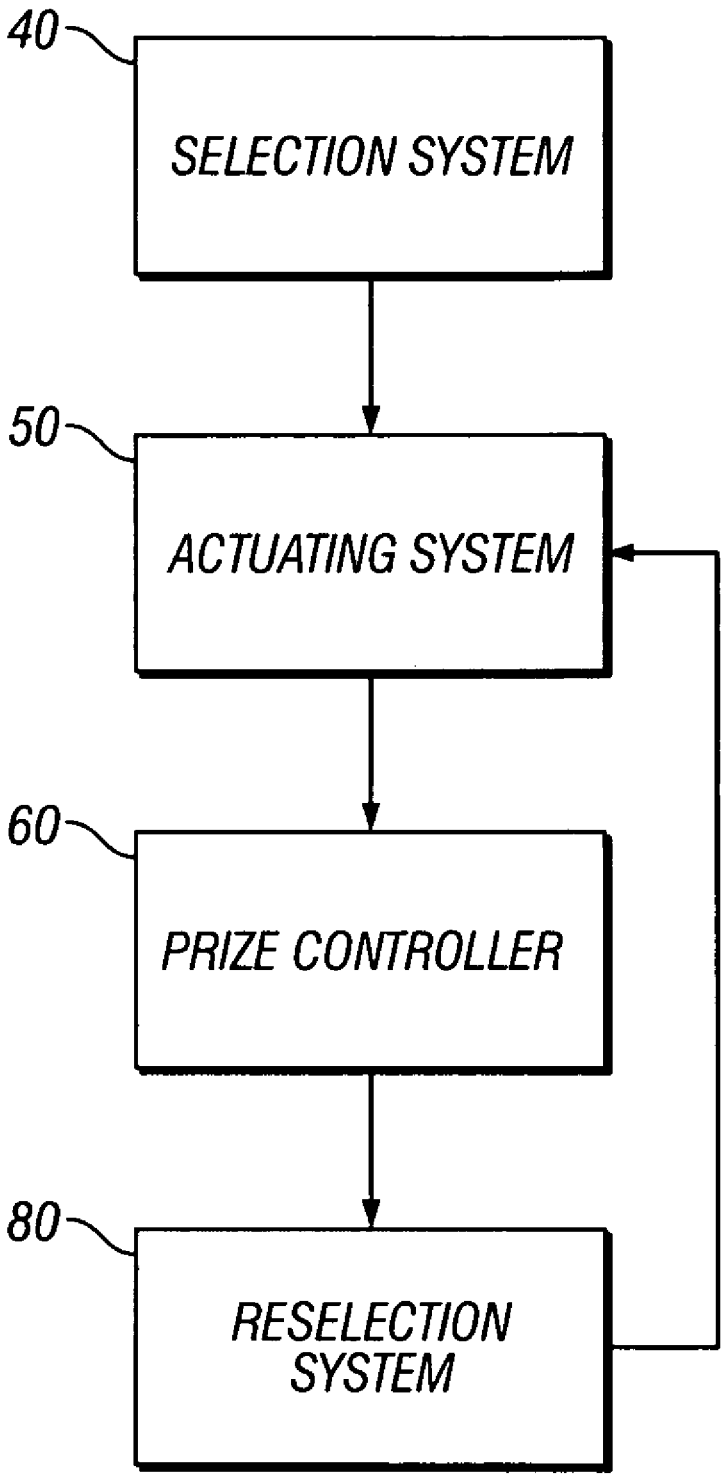
FIG. 2B illustrates a relational flow of a preferred method, showing the interaction of a selection system, an actuating system, a prize controller, and a reselection system.

The selection system 40 (or a reselection system 80 in some preferred embodiments, as shown in FIG. 2B) then designates a new subset of the selectable reels 20 as the active reels 70 for the second game by substituting a non-active reel from the initial game for an active reel from the initial game. Specifically, the active reels 70 for the second game include the newly substituted active reel and the remaining active reels from the initial game. The actuating system 50 then spins the newly substituted active reel, but does not spin the remaining active reels from the initial game. The prize controller 60 then determines whether or not a prize is to be awarded dependent upon the combination of the outcome symbol 30 from the newly substituted active reel and the outcome symbols of the remaining active reels from the initial game. This process is repeated for each subsequent consecutive game until all of the games purchased by the player (or otherwise entitled to the player) have been exhausted.

Figure 4:
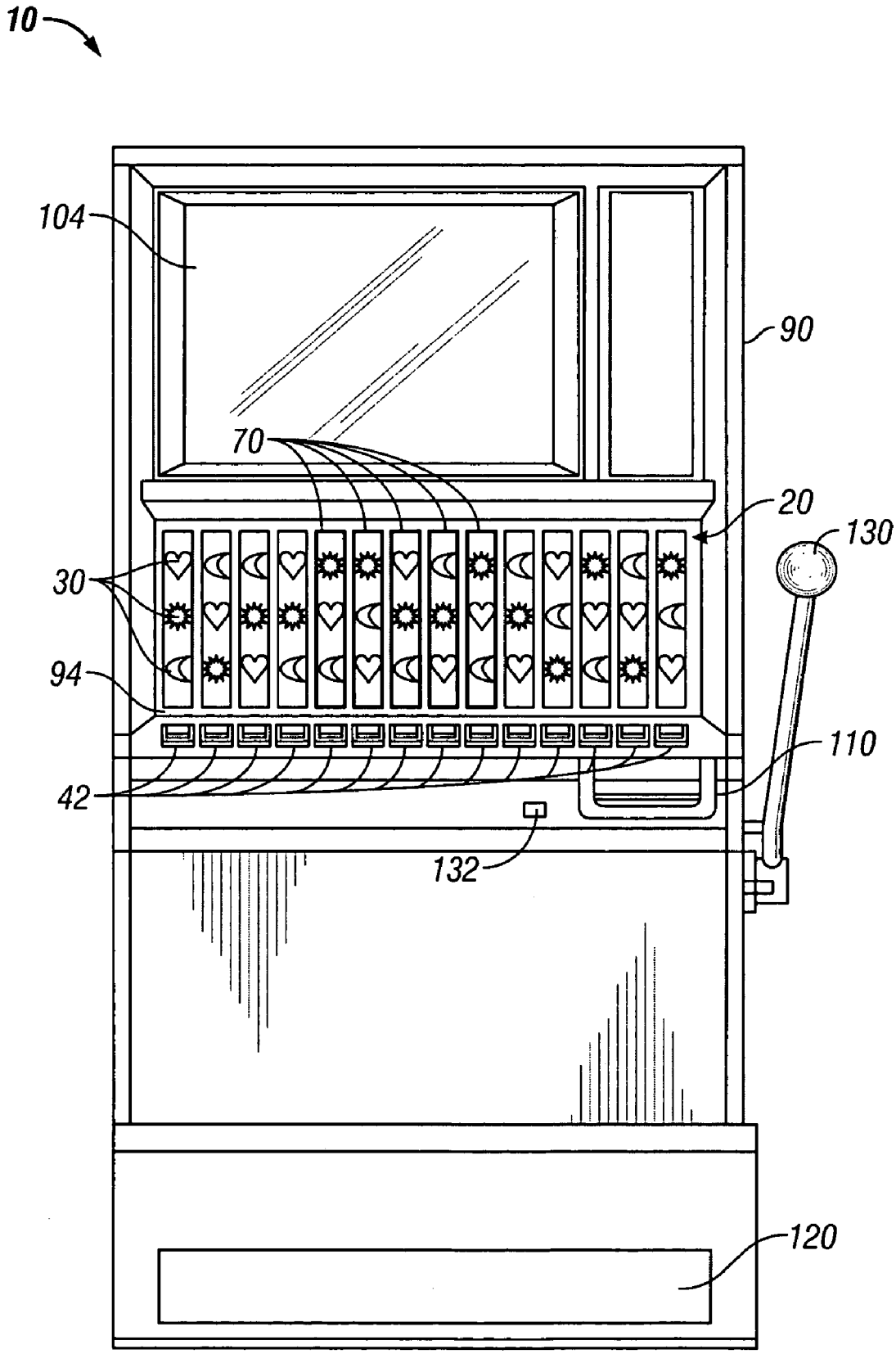
FIG. 4 illustrates a front view of the embodiment shown in FIG. 1, showing five of the selectable reels having been designated as active reels, as shown by the highlighting of the active reels.

More specifically, in one embodiment, the reel spinning gaming device 10 includes fourteen selectable reels 20 housed inside a cabinet 90 that has a display window 94. As shown in FIG. 1, the fourteen reels are aligned in a single row. In one preferred embodiment, as shown in FIGS. 3 and 4, five of the fourteen reels are designated as the active reels 70 for the initial game. Preferably, the game symbols are located on the periphery of each of the reels 20, and are used to determine the outcome of each individual game in which the reels were designated as active reels 70 (i.e., as outcome symbols 30). The outcome symbols 30 are visible on a pay line through the window 94. The outcome is determined from the combination of the outcome symbols 30 displayed by the active reels 70 on the pay line. It will be understood that gaming device 10 can also be constructed with a greater or lesser number of display reels 20. Further, a greater or lesser number of active reels 70 may be used.

Other preferred embodiments may utilize multiple pay lines, and thus, have more than one symbol position (outcome symbol 30) of each reel 20 visible at a time through the window 94. In another preferred embodiment, a video slot system may be used instead of the mechanical slot system described above. In still another preferred embodiment, a hybrid slot system may be used in which some of the reels in the slot machine are mechanical and some of the reels in the slot machine are produced by a video display.

In one preferred embodiment, selection buttons 42, which act as part of the selection system 40, are located in front of each selectable reel 20. The selection buttons 42 are used by a player to select which of the plurality of selectable reels 20 are to be designated as the active reels 70 for a particular game. The selection buttons 42 send signals within the selection system 40 that instruct the gaming device 10 which reels are active, and which reels are to be spun by the actuating system 50. Typically, at least part of the selection system 40 and the actuating system 50 are incorporated into a game microprocessor unit that is responsible for controlling game operations.

In one preferred embodiment, only the initial active reels 70 are spun by the actuating system 50 in the initial game, and only the newly substituted active reel is spun by the actuating system 50 in each subsequent consecutive game. Thus, the non-active reels are not typically spun by the actuating system 50 in the initial game, and both the non-active reels and the remaining active reels are not typically spun by the actuating system in each subsequent consecutive game. However, in other preferred embodiments, the non-active reels are also spun, in order to further increase player excitement by the "allure of what could have been," had other reels been selected as the initial active reels 70 or the newly substituted active reel. In such an embodiment, even though the non-active reels are spun by the actuating system 50, they are not used to determine whether or not a prize has been won.

Figure 5:
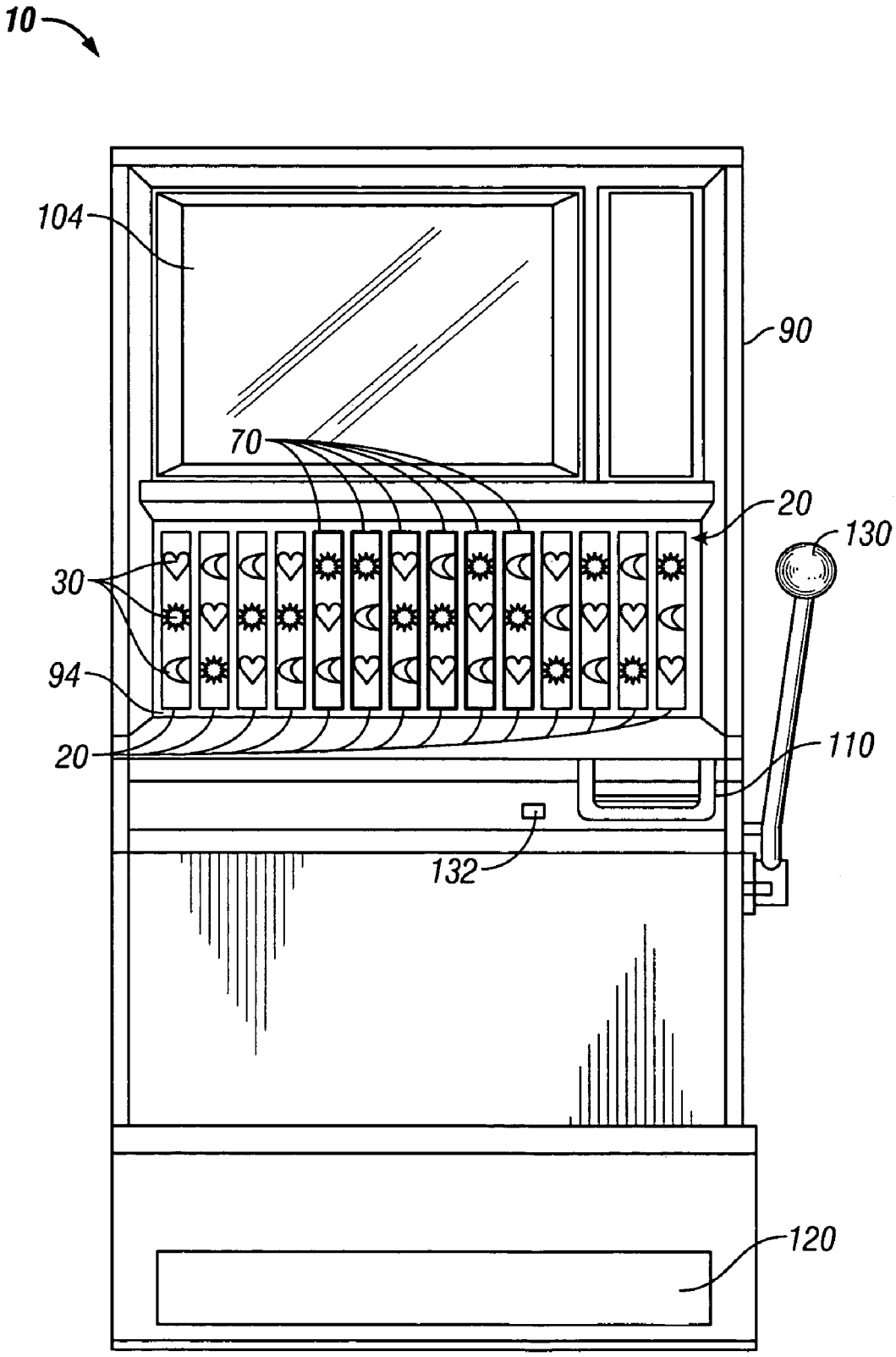
FIG. 5 illustrates a front view of a preferred embodiment, constructed in accordance with the invention, having fourteen selectable reels and an associated touch screen, the touch screen being used as part of a selection system and a reselection system.

In another embodiment, as shown in FIG. 5, the selection system 40 incorporates touch screen technology that allows a player to select which of the plurality of selectable reels 20 are to be designated as the active reels 70 by touching a portion of the window 94 in front of the desired mechanical reels or video representation of reels. In still other embodiments, the selection system 40 automatically selects which of the plurality of selectable reels 20 are to be designated as the active reels 70, independent of player input.

In one exemplary embodiment, in accordance with conventional design, each selectable reel preferably includes a stepper motor that acts as part of the actuating system 50 to spin the reel. Each reel further includes an outer rim portion on which the game symbols are located. A mount secures and locates the stepper motor of each reel to the cabinet 90 such that one symbol, i.e., the outcome symbol 30, is visible through the window 94 on the pay line of the gaming device 10. The game microprocessor unit that controls the gaming operations is also located within the cabinet 90 of the gaming device 10. Either the game microprocessor unit, or the actuating system 50 itself, provides a drive signal to the stepper motors associated with the reels 20 that causes the reels to spin. In this manner, the actuating system 50 may be considered part of the game microprocessor unit in some configurations of the game device 10.

The game microprocessor unit also provides signals to the stepper motors associated with the reels 20 to cause the reels to halt in a particular position and to display outcome symbols 30 on the pay line that correspond to a particular outcome symbol combination (i.e., game result). The prize controller 60, which may also be incorporated as part of the game microprocessor unit, then determines whether or not a prize is to be awarded (i.e., makes a prize determination) dependent upon the outcome symbol combination of either the initial active reels 70 for the initial game or the newly substituted active reel and the remaining active reels for each subsequent consecutive game.

In accordance with conventional design, the gaming device 10 preferably also includes a coin slot 110 for receiving coins, a tray 120 for dispensing coins, and a user-actuated play handle 130 for initiating game play. A user-actuated play button 132 for initiating game play is typically also provided in order to appeal to varying player preferences. Within the cabinet 90, the gaming device 10 preferably includes a coin-dispensing unit of conventional design. To initiate play of the game, one or more coins are received through the coin slot 110 of the gaming device 10. Cashless technology may also be used herein.

In some embodiments, a reselection system 80 is also included in the gaming device 10 and is used to select and substitute a previously non-active reel from the plurality of selectable reels 20 for a previously active reel from the group of active reels 70. The reselection system 80 then designates this new subset of reels as the active reels 70 for the next game. Specifically, the active reels 70 for the subsequent consecutive game include the next active reel and the remaining active reels from the previous game. The actuating system 50 then spins the newly substituted active reel, but does not spin the remaining active reels from the previous game. The prize controller 60 then awards a prize dependent upon the combination of the outcome symbol 30 from the newly substituted active reel and the outcome symbols 30 from the previously spun remaining active reels. This process is repeated until all of the subsequent consecutive games purchased by the player (or otherwise entitled to the player) have been exhausted.

Figure 6:
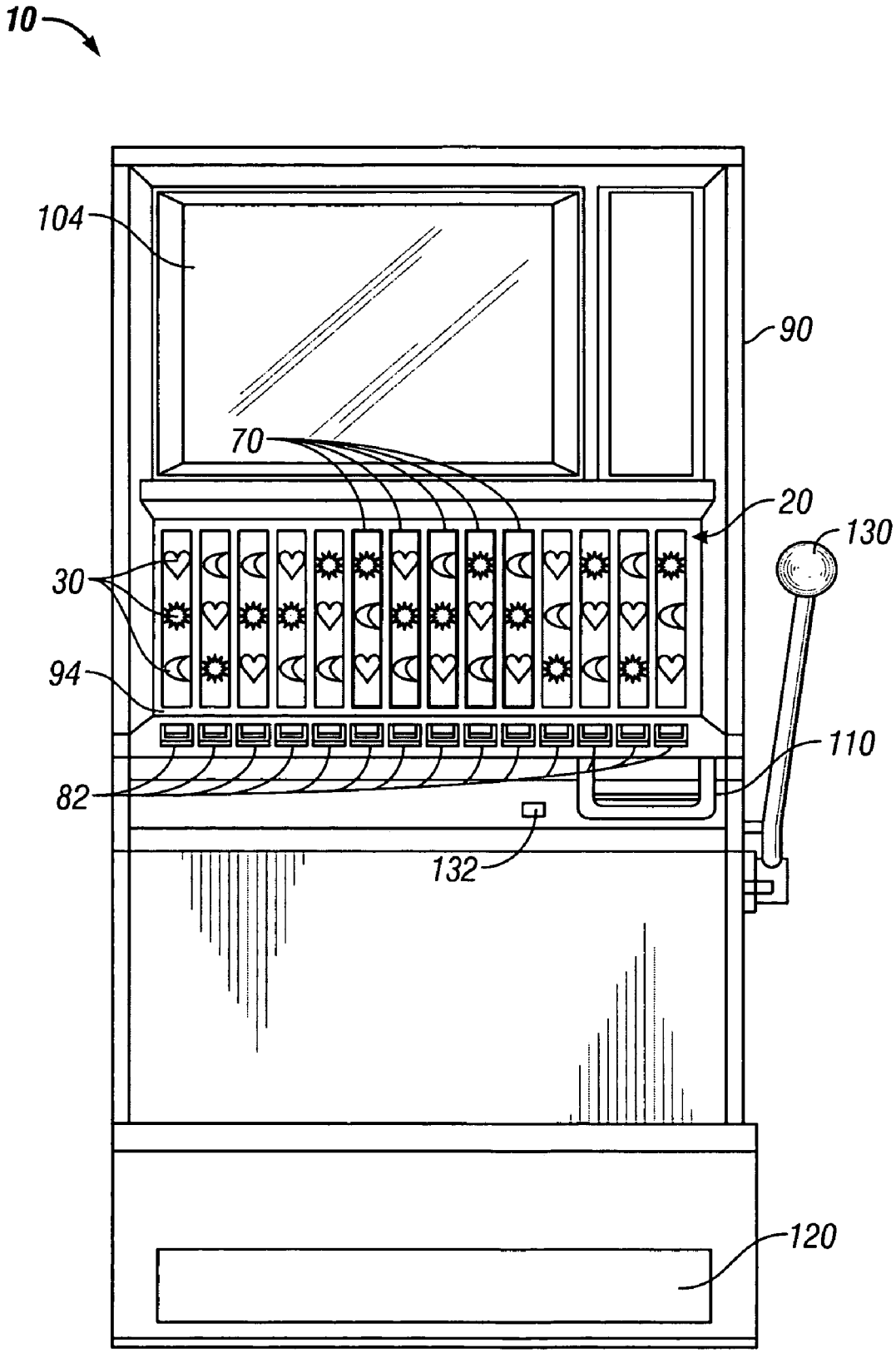
FIG. 6 illustrates a front view of the embodiment shown in FIG. 4, showing the rightmost active reel having become non-active, and a new previously non-active reel having been added to the left end of the remaining active reels, as shown by the highlighting of the active reels.
Figure 7:
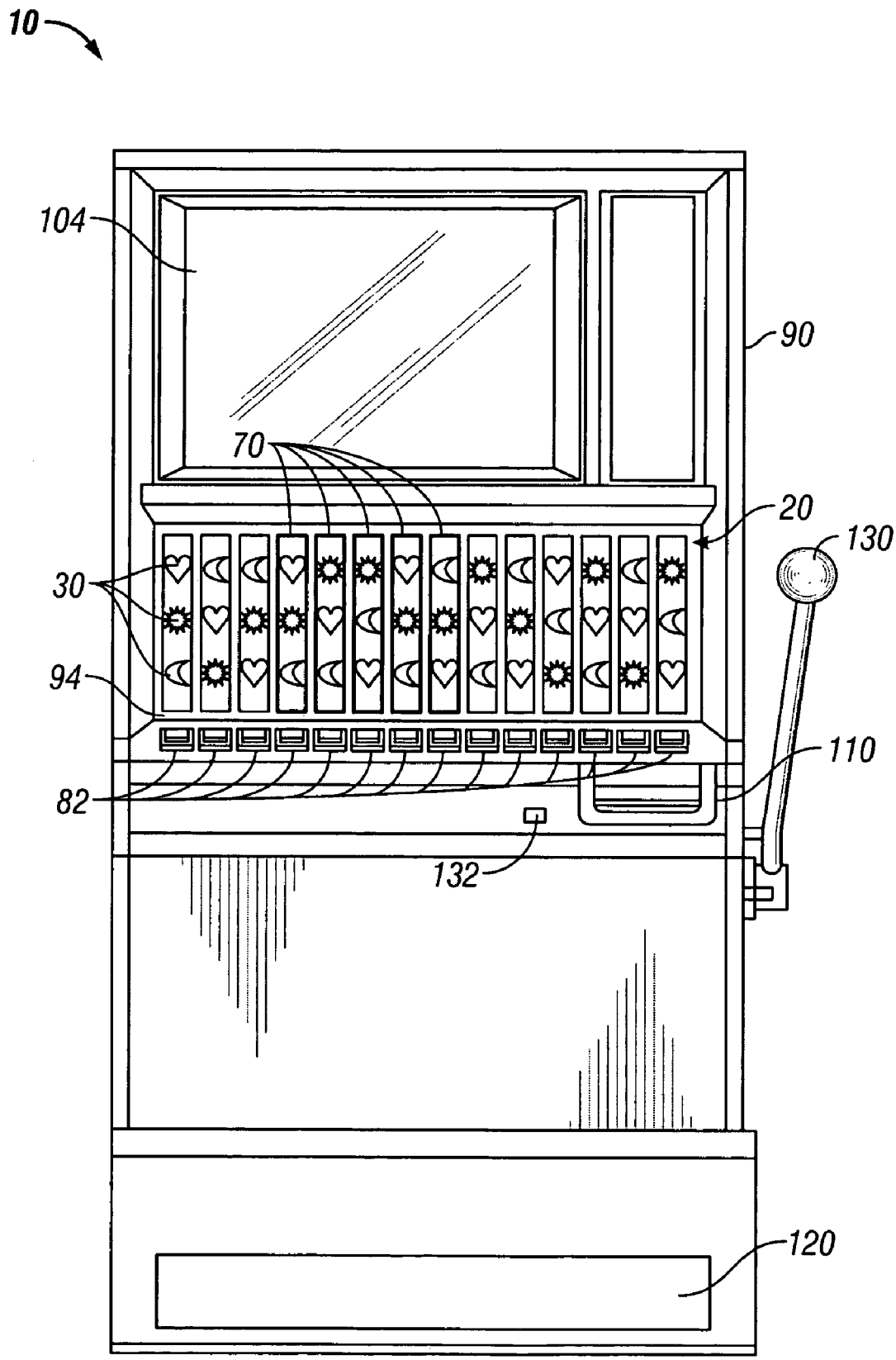
FIG. 7 illustrates a front view of the embodiment shown in FIG. 4, showing the leftmost active reel having become non-active, and a new previously non-active reel having been added to the right end of the remaining active reels, as shown by the highlighting of the active reels.
Figure 8:
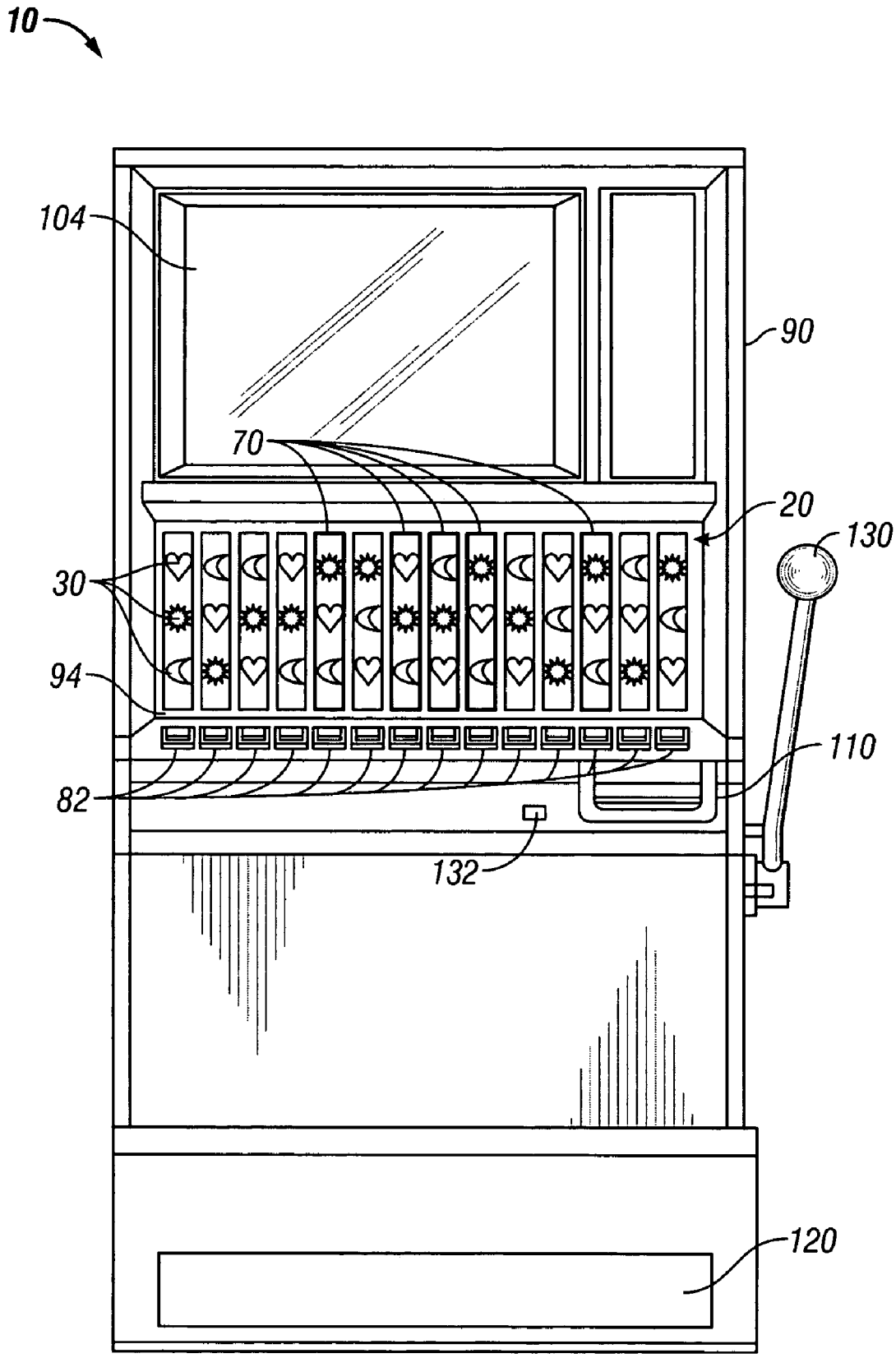
FIG. 8 illustrates a front view of the embodiment shown in FIG. 3, showing a randomly selected active reel having become non-active, and a new previously non-active and non-contiguous reel having been added to the remaining active reels, as shown by the highlighting of the active reels.

In one preferred embodiment, the reselection system 80 includes reselection buttons 82 that are located in front of each selectable reel 20. As shown in FIGS. 6-8, the reselection buttons 82 may be the same buttons that are used as the selection buttons 42 in some preferred embodiments. The reselection buttons 82 allow a player to select which non-active reel from the plurality of selectable reels 20 is to be designated as a newly substituted active reel for each subsequent consecutive game. The reselection buttons 82 send signals to the selection system 80 to instruct the gaming device 10 which reel is designated as the newly substituted active reel to be spun by the actuating system 50. In other preferred embodiments, the selection system 40 functions as both the selection system 40 and the reselection system 80, thereby removing the need for an independent reselection system 80.

Similar to selection system 40 discussed above with respect to FIG. 5, in other embodiments the reselection system 80 incorporates touch screen technology that allows a player to select which non-active reel from the plurality of selectable reels 20 is designated as a newly substituted active reel for each subsequent consecutive game. This is accomplished by touching the portion of the window 94 in front of the desired mechanical reel or video representation of a reel. In still other embodiments, the reselection system 80 automatically selects one of the selectable reels 20 to be designated as a newly substituted active reel for each subsequent consecutive game (and which active reel is to become non-active), independent of player input.

As shown in FIG. 6, in a preferred embodiment that incorporates an automatic reselection system, the active reels shift to the left by one reel each game, such that one active reel becomes non-active while a new, previously non-active reel becomes active at the other end. In one embodiment, the starting positions of the active reels within the total set of reels is preferably at the right end of the reels (in order to allow for the maximum number of reel shifts to the left); however, the starting positions of the active reels within the total set of reels varies between preferred embodiments.

As shown in FIG. 7, in another preferred embodiment that incorporates an automatic reselection system, the reels shift to the right by one reel (instead of to the left) each game, such that one active reel becomes non-active while a new, previously non-active reel becomes active at the other end. In one embodiment, the starting positions of the active reels within the total set of reels is preferably at the left end of the reels (in order to allow for the maximum number of reel shifts to the right); however, the starting positions of the active reels within the total set of reels varies between preferred embodiments.

In still other preferred embodiments, as shown by either FIG. 6 or 7, the direction of the reel shifting is completely random, such that one randomly selected active reel becomes non-active at of one end of the reels, while a new, randomly selected, previously non-active reel becomes active to the other end of the reels. In yet another preferred embodiment, as shown in FIG. 8, one active reel that is randomly selected from amongst the group becomes non-active (not necessarily from the one of the ends), while a new, randomly selected, previously non-active reel becomes active (also not necessarily at one of the ends); thus, resulting in a new group of active reels that may not be contiguous.

In other preferred embodiments, either a greater or lesser number of reels may be designated as the active reels 70. In another aspect of a preferred embodiment, a greater number of reels may be substituted and replaced as the active reels between each game. In still another aspect, the active reels 70 are designated as active by using one of several different techniques. In one such embodiment the active reels 70 are designated as active by highlighting at least a portion of the active reels, as shown in FIGS. 4 and 6-8. In another such embodiment, the active reels 70 are designated as active by de-emphasizing at least a portion of the non-active reels, as shown in FIG. 3. Such de-emphasizing can be achieved by shading or any other known technique. Finally, in yet another embodiment, the active reels 70 are designated as active by covering or otherwise eliminating at least a portion of the non-active reels from the player's view.

In one preferred embodiment, continuing in accordance with conventional design, game control circuits receive signals from a conventional coin-in detector or related cashless technology and a conventional spin switch, which may be either a user-actuated play button switch 132, as described above, or a user-actuated play handle switch 130, as described above. The game microprocessor unit, utilizing a stored random number-generating algorithm, generates a random number. This number is applied to a memory device, preferably taking the form of a plug-in EPROM, in which a look-up table has been stored. In additional embodiments, CD-ROMs or other memory devices may also be used. The prize control unit 60 utilizes this number in conjunction with the stored look-up table in an EPROM or other memory device to select a game result. The look-up table contains a specific game result in the form of a game symbol to be displayed (e.g., blank, 7, bar, double bar, triple bar, or cherry) for each reel and for each applied random number. In this manner, the general functionality of a typical reel spinning slot machine is implemented in accordance with a preferred embodiment.

An example of a preferred reel spinning gaming device 10 is now described in operation. First, the gaming device 10 accepts a wager from a player to purchase game play, typically for multiple games. Next, a subset of the plurality of selectable reels 20 is selected as the active reels 70 for the initial game. When activated, these designated selectable reels (i.e., the active reels 70) begin to spin. At some point thereafter the reels 70 are subsequently stopped, thus producing a game result that is determined by the combination of the outcome symbols 30 displayed by the active reels along the pay line. The prize control unit 60 then awards a prize if a winning outcome symbol combination has been obtained. This concludes the initial play of the game of the invention; however, subsequent consecutive games that utilize a portion of the outcome symbol combination from the initial game usually continue since a player typically engages in multiple consecutive games until all of the games that the player has wagered for (or is otherwise entitled to) have been exhausted.

If the player has provided a sufficient wager, game play continues with a first subsequent consecutive game (i.e., the second game). In the first subsequent consecutive game, one of the active reels from the initial game is substituted for one of the non-active reels from the initial game. This newly substituted active reel, which was a non-active reel in the initial game, is then designated as an active reel for the second game, along with the remaining active reels from the initial game. The newly substituted active reel is then spun, and subsequently stopped to display an outcome symbol 30 along the pay line. The remaining active reels are not spun at this time. The outcome symbol 30 from the newly substituted active reel is used in conjunction with the outcome symbols 30 from the initial game displayed by the remaining active reels, in order to produce an outcome symbol combination that determines the game result for the second game. The prize control unit 60 then awards a prize for any new wins from this new outcome symbol combination for the second game. This concludes the second individual game; however, as described above, subsequent consecutive games that utilize a portion of the outcome symbol combination from either the previous game or the initial symbol outcomes from the initial active reels continue until all of the multiple games that the player has wagered for (or is otherwise entitled to) have been exhausted.

If the player has provided a sufficient wager, game play continues with the next subsequent consecutive game (i.e. the third game). In the next subsequent consecutive game one of the active reels from the second game is substituted for one of the non-active reels from the second game. This newly substituted active reel, which was a non-active reel in the second game, is then designated as an active reel for the third game, along with the remaining active reels from the second game. The newly substituted active reel is then spun, and subsequently stopped to display an outcome symbol 30 along the pay line. The remaining active reels are not spun at this time. The outcome symbol 30 from the newly substituted active reel is used in conjunction with the outcome symbols 30 from the previously spun remaining active reels, in order to produce an outcome symbol combination that determines the game result for the third game. The prize control unit 60 then awards a prize for any new wins from this new outcome symbol combination for the third game. This concludes the third individual game; however, as described above, this substitution, spinning, and awarding process is repeated sequentially, based upon the active reels for each individual game, until all of the multiple games that the player has wagered for (or that the player is otherwise entitled to) have been exhausted.

In one exemplary embodiment, a gaming device has fourteen selectable reels numbered one through fourteen. An initial game is played by spinning reels one through five, which are designated as the initial active reels in the first game. The prize controller makes a prize determination as to whether a prize is to be awarded based upon the outcome symbols of the initial active reels in the first game. The second game then begins in which reel number one becomes a non-active reel, reel number six becomes a newly substituted active reel, and reels two through five become the remaining active reels for the second game. The newly substituted active reel (i.e., reel six) is spun in the second game while the remaining active reels (i.e., reels two through five) are not spun in the second game. The prize controller makes a prize determination as to whether a prize is to be awarded based upon the outcome symbol from the newly substituted active reel (i.e., reel six) that was just spun in the second game and outcome symbols from the remaining active reels (i.e., reels two through five) that were not spun in the second game.

Following this same example, the third game then begins in which reel number two becomes a non-active reel, reel number seven becomes a newly substituted active reel, and reels three through six become the remaining active reels for the third game. The newly substituted active reel (i.e., reel seven) is spun in the third game while the remaining active reels (i.e., reels three through six) are not spun in the third game. The prize controller makes a prize determination as to whether a prize is to be awarded based upon the outcome symbol from newly substituted active reel (i.e., reel seven) that was just spun in the third game and the outcome symbols from the remaining active reels (i.e., reels three through six) that were not spun in the third game. This process is repeated for any additional games until a predetermined criteria has been satisfied or until all games purchased by the player have been played. It is to be understood, however, that any active reel can be replaced by a non-active reel. Thus, the initial active reels can remain, i.e., the player can use the best symbol outcome from the initial spin of the active reels, and the newly substituted reel can be replaced by another non-active reel.

In one variation of the previous example, the second and any subsequent games have more than one active reel substituted for an equal number of non-active reels. For instance, reels one and four become non-active reels, and reel number six and seven become newly substituted active reels. The newly substituted active reel (i.e., reels six and seven) are spun in the second game while the remaining active reels (i.e., reels two, three, and five) are not spun in the second game. The prize controller makes a prize determination as to whether a prize is to be awarded based upon the outcome symbol from the newly substituted active reels (i.e., reels six and seven) that were just spun in the second game and outcome symbols from the remaining active reels (i.e., reels two, three, and five) that were not spun in the second game.

In yet another variation of the previous example, any game subsequent to the initial game may have weighted payouts. That is, for instance, a payout for the winning outcome in a second game is greater than the payout in the initial game, and the payout for the same winning outcome in a third game is greater than the payout in the second game, and so forth for each consecutive game play. Accordingly, a player may be induced into buying additional reels for the chance not only to obtain a winning outcome, but also the chance for larger payouts for a winning outcome in subsequent games as compared to the payout value in the initial game.

In another preferred embodiment, newly substituted active reels may each have weighted payouts. Accordingly, a payout for a later purchased reel would be greater than the payout for an earlier purchased reel. In yet another variation of this preferred embodiment, a weighted payout is paid only if the symbol for the later purchased reel produces a winning outcome when combined with the previously active reels. For instance, in an initial game, reels one through five are spun and the resulting outcome symbols are "blank-blank-cherry-cherry-cherry." The player would be awarded a prize for the symbol combination of "cherry-cherry-cherry." If the player purchases an additional reel (e.g. reel six), reel one is inactivated, and the symbol outcome for reel six is a "bar," the player would not receive a weighted payout because the "bar" outcome symbol in combination with the outcome at the previously active reels (blank-cherry-cherry-cherry) does not produce a new winning outcome. That is, the winning outcome (cherry-cherry-cherry) from the initial game was not improved upon with the addition the outcome symbol of reel six (bar). In contrast, if reel six is spun and the symbol outcome is a "cherry," the player would receive a weighted payout as the "cherry" symbol from reel six produces a new winning outcome of four consecutive cherries. Alternatively, the player may be entitled to a weighted payout as the new "cherry" symbol of reel six can be combined with outcome symbols from the initial game (i.e., reels four and five (cherry-cherry)) to produce a winning combination of cherry-cherry-cherry.

In another preferred embodiment of the gaming device, an initial game is played by spinning a subset of the total number of reels, which are designated as the initial active reels in the first game. The prize controller makes a prize determination as to whether a prize is to be awarded based upon the outcome symbols of the initial active reels in the base game. Additionally, the prize controller determines whether a triggering event is present to initiate one or more bonus games. The bonus game then begins in which one or more of the initial active reels in the base game become non-active reel(s), and one or more previously non-active reels become active reel(s) in the bonus game. The newly substituted active reel(s) is/are spun in the bonus game while the remaining active reels are not spun in the bonus game. The prize controller then makes a prize determination as to whether a prize is to be awarded based upon the outcome symbol from the newly substituted active reel(s) that was just spun in the bonus game and the outcome symbols from the remaining active reels that were not spun in the bonus game. This process can be repeated for any number of bonus games until a predetermined criteria has been satisfied or until the player stops playing the gaming device.

In a preferred embodiment, the triggering event is one or more triggering symbols displayed on the active reels. In another preferred embodiment, the triggering event may be a winning outcome having a particular value. For instance, the game result that triggers the bonus game may be a winning outcome of at least 25 credits. As those skilled in the art will appreciate, a casino operator or the manufacturer can determine the minimum winning outcome that is the triggering event. In another embodiment, the triggering event may be randomly generated. In yet another preferred embodiment, the triggering event may be a combination of events such as, but not limited to, a maximum wager and the presence of a particular triggering symbol(s) on one or more of the active reels. Player status, time of day or date, length of play, may also be a triggering event. Essentially almost anything can operate as a triggering event.

In another preferred embodiment, the bonus game includes one or more symbols that are specific to the bonus game. In one embodiment, these symbols may denote the term "bonus." In another embodiment, these symbols may be a symbol that depicts the "theme" of the game. For instance, the symbol may be a depiction of a pile of gold for a "Go for Gold" gaming machine. In one preferred embodiment, these bonus game symbols can provide additional or specific awards. For instance, in one preferred embodiment, the higher award values are awarded in the bonus game if the winning outcome includes a bonus symbol. In another preferred embodiment, the bonus symbols correspond to tangible prizes such as, but not limited to, a house, car, motorcycle, jewelry, or the like. In another preferred embodiment, the bonus symbols correspond to services such as, but not limited to, vacations, cruise trips, spa packages, free hotel rooms, or the like. In yet another preferred embodiment, the bonus symbols are multipliers so that a winning outcome in the base game is multiplied by some factor when the multiplier symbol appears with the winning outcome of the base game.

In one preferred embodiment of the gaming device, an initial game is played by spinning a subset of the total number of reels, which are designated as the initial active reels of the first game. Regardless of the outcome of the first game, the player can purchase one or more reels for a second game. Accordingly, additional reels can be applied to the result of the first game in an attempt to obtain a winning outcome or to improve upon a winning outcome. In one preferred embodiment, only the reels purchased for the second game are spun. In another preferred embodiment, both the purchased reels and the initially active reels are spun in the second game. In either preferred embodiment, the purchased reel(s) can replace one or more active reels from the first game. Alternatively, the purchased reel(s) can supplement the active reels from the first game.

Figure 9:
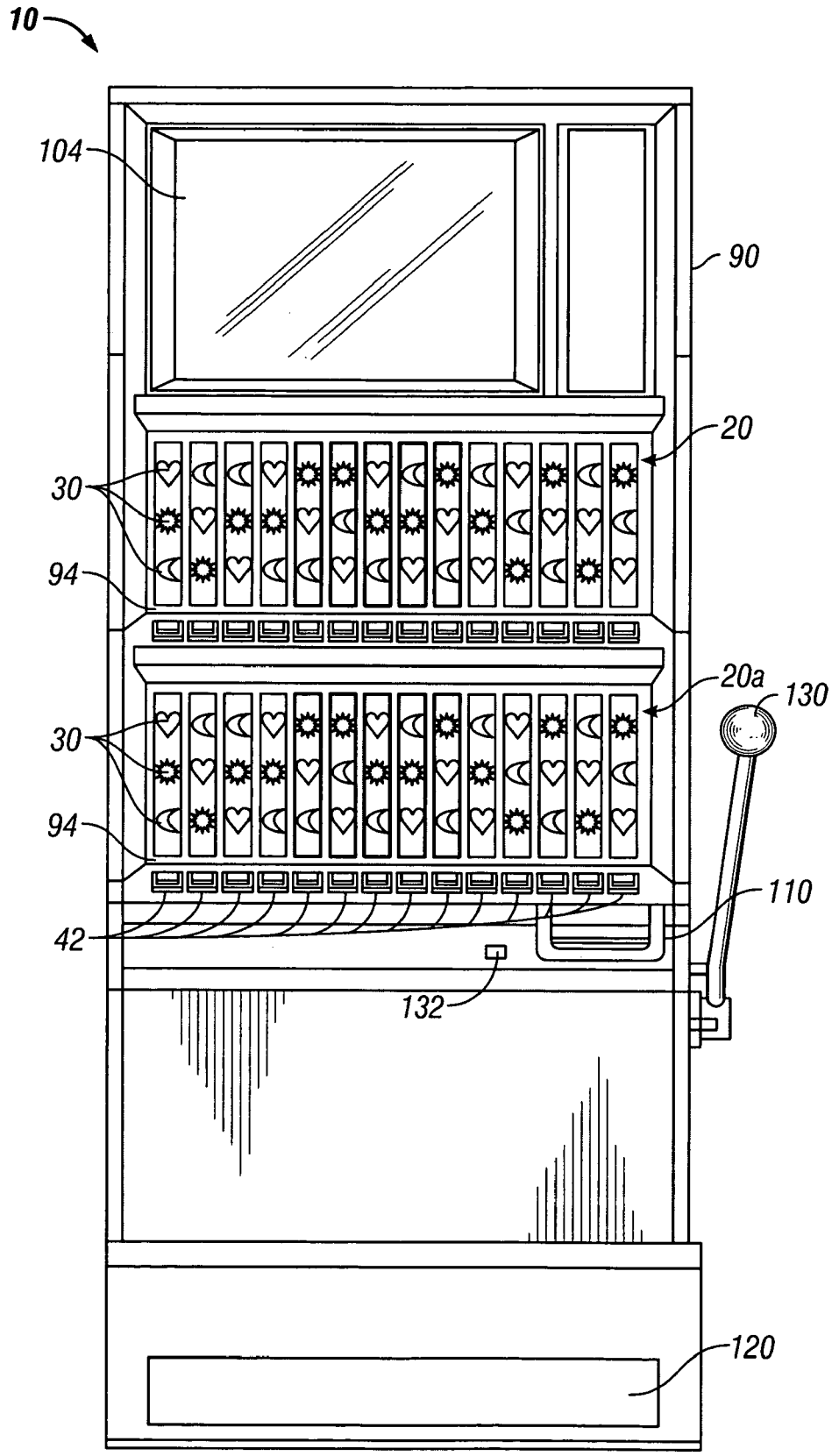
FIG. 9 illustrates a front view of a preferred embodiment, constructed in accordance with the invention, having 3 rows of selectable reels and associated selection buttons, the selection buttons being used as part of a selection system and a reselection system.

Referring to FIG. 9, one preferred embodiment includes a plurality of reels aligned in a grid having a plurality of rows and columns. For instance, the grid may be composed of two rows 20 and 20*a* where each row has fourteen reels. As those skilled in the art will appreciate, the plurality of reels may be configured in any variation in the number of rows and columns. In fact, the reels can be placed in any configuration desired. For instance, the reels can be configured in the shape of a square, diamond, triangle, or any other polygonal shape. In this embodiment, a subset of the reels in the first row of reels is designated as the active reels 70 for the initial game, and one or more non-active reels from subsequent rows of reels may be substituted for the active reels in the initial game. In other embodiments, a subset of one or more column of reels is designated as the active reels 70 for the initial game, and one or more non-active reels from other columns may be substituted for the active reels in the initial game.

In another preferred embodiment of the reel spinning gaming device 10, the prize controller is not located within the gaming device. Rather, the prize controller may be located at a remote location such as, but not limited to, a server. Accordingly, in this embodiment, the prize controller is networked with the reel spinning device.

In another preferred embodiment of the reel spinning gaming device 10, a display 104 is provided housed in the cabinet 90. In one embodiment, the display 104 is a video display. In yet another embodiment, the display 104 is a top glass. In one embodiment, the display 104 is used in conjunction with a bonus game. In another embodiment, the display 104 may be used to show outcome symbols 30 for the active reels 70. In yet another embodiment, the display 104 may display a paytable for the initial game, subsequent games, and/or a bonus game. The display 104 may also be used to display a jackpot amount (e.g., non-progressive or progressive jackpots). Alternatively, the display 104 may display the game's name or provide other non-gaming information to a player.

Furthermore, the various methodologies described above are provided by way of illustration only and should not be construed to limit the invention. Those skilled in the art will readily recognize various modifications and changes may be made to the invention without departing from the true spirit and scope of the invention. Accordingly, it is not intended that the invention be limited, except as by the appended claims.

What is claimed is:

1. A gaming system that allows a player to play multiple games, wherein each actuation of indicia-bearing members constitutes a game, the system comprising:

a gaming device comprising a plurality of selectable indicia-bearing members, wherein a subset of the plurality of indicia-bearing members are initial active members for a base game;

an actuating system operatively associated with the indicia-bearing members, wherein the actuating system generates an outcome symbol combination for the active indicia-bearing members in the base game;

a prize controller for determining whether a prize should be awarded based upon the outcome symbol combination of the base game and whether a triggering event is present to initiate a bonus game; and a reselection system that designates a new set of indicia-bearing members for one or more bonus games, wherein the new set of indicia-bearing members comprises one or more newly active indicia-bearing members that were previously non-active indicia-bearing members and one or more remaining active indicia-bearing members, and wherein the outcome symbols from the one or more newly active indicia-bearing members are used in conjunction with the outcome symbols from the remaining active indicia-bearing members to produce an outcome symbol combination for one or more bonus games.

2. The gaming system of claim 1, further comprising a selection system operatively associated with each selectable indicia-bearing member, wherein the selection system designates the subset of the selectable indicia-bearing members as the initial active members for the base game.

3. The gaming system of claim 1, wherein one or more newly active indicia-bearing members are only actuated for the bonus games.

4. The gaming system of claim 1, wherein the triggering event is one or more winning outcomes in the base game, a maximum wager, one or more bonus symbols appearing on one or more of the active indicia-bearing members in the base game, player status, time of day, a particular date, length of play by a player, or a combination thereof.

5. The gaming system of claim 1, wherein one or more outcome symbols are reserved only for the bonus games.

6. The gaming system of claim 1, wherein the selectable indicia-bearing members are arranged in a grid, wherein the grid comprises a plurality of rows and columns of selectable indicia-bearing members and the grid having the shape of a square, diamond, triangle, or polygon.

7. The gaming system of claim 1, wherein the prize controller is located on a server, wherein the server is remote from the gaming device.

8. The gaming system of claim 1, wherein the value of the prize for the bonus game is greater than the value of the prize for the base game.

9. A gaming system that allows a player to play multiple games, wherein each actuation of indicia-bearing members constitutes a game, the system comprising:

a gaming device comprising a plurality of selectable indicia-bearing members, wherein a subset of the plurality of indicia-bearing members are initial active members for a base game;

an actuating system operatively associated with the selectable indicia-bearing members, wherein the actuating system generates an outcome symbol combination for the active members in the initial game;

a prize controller for determining whether a prize should be awarded based upon the outcome symbol combination of the initial game; and a reselection system for selecting a new set of indicia-bearing members for one or more subsequent games, wherein the new set of active indicia-bearing members comprises one or more newly active indicia-bearing members that were previously non-active indicia-bearing members and one or more remaining active indicia-bearing members, and wherein the outcome symbols from the one or more newly active indicia-bearing members are used in conjunction with the outcome symbols from the remaining indicia-bearing members to produce an outcome symbol combination for the subsequent games.

10. The gaming system of claim 9, further comprising a selection system operatively associated with each selectable indicia-bearing member, wherein the selection system designates the subset of the selectable indicia-bearing members as the initial active indicia-bearing members for the initial game.

11. The gaming system of claim 9, wherein one or more newly active indicia-bearing members are only actuated for the subsequent games.

12. The gaming system of claim 9, wherein the selectable indicia-bearing members are arranged in a grid, wherein the grid comprises a plurality of rows and columns of selectable indicia-bearing members and the grid having the shape of a square, diamond, triangle, or polygon.

13. The gaming system of claim 9, wherein winning outcome symbol combinations have weighted payouts, wherein winning outcome symbol combinations in subsequent games have greater payouts as compared to the payouts for earlier games.

14. The gaming system of claim 9, wherein the reselection system allows a player to purchase one or more indicia-bearing members for one or more subsequent games.

15. The gaming system of claim 9, wherein the prize controller is located on a server, wherein the server is remote from the gaming device.

16. A gaming method, the method comprising:

providing a gaming device comprising a plurality of selectable indicia-bearing members having symbols thereon;

selecting an initial set of indicia-bearing members for an initial game, wherein the initial set of indicia-bearing members is a subset of the plurality of selectable indicia-bearing members;

actuating the initial set of active indicia-bearing members to generate an outcome symbol combination in the initial game, wherein the outcome symbol combination comprises the symbols provided on the active the indicia-bearing members;

determining whether a prize is to be awarded based upon the outcome symbol combination in the initial game;

determining whether to initiate one or more subsequent games;

initiating subsequent games, if appropriate, by selecting a new set of indicia-bearing members, wherein the new set of active reels comprises one or more new active indicia-bearing members that were previously non-active indicia-bearing members and one or more remaining active indicia-bearing members;

actuating one or more of the new active indicia-bearing members to generate an outcome symbol in the subsequent games; and determining whether a prize is to be awarded based upon the outcome symbol in the subsequent game in conjunction with the outcome symbols from the active indicia-bearing members remaining from the initial game.

17. The method of claim 16, wherein the selecting step in the initial game is player controlled or computer controlled.

18. The method of claim 16, wherein the selecting the new set of active indicia-bearing members in the subsequent games is player controlled or computer controlled.

19. The method of claim 16, wherein the subsequent game is a bonus game.

20. The method of claim 19, wherein the bonus game further comprises outcome symbols specific to the bonus game.

21. The method of claim 16, wherein initiating the subsequent game further comprises purchasing the new set of active indicia-bearing members.

22. The method of claim 16, wherein selecting a new set of active indicia-bearing members is player controlled.

23. The method of claim 16, wherein selecting a new set of active indicia-bearing members is computer controlled.

24. The method of claim 16, wherein the prize for the subsequent game is greater than the prize for the initial game.

* * * * *